United States Patent [19]

Ambrose

[11] 3,989,115

[45] Nov. 2, 1976

[54] ADJUSTABLE GAGE CUTTER SCRAPER FOR TUNNELING MACHINES

[75] Inventor: Albert Robin Ambrose, Beaumont, Tex.

[73] Assignee: Dresser Industries, Inc., Dallas, Tex.

[22] Filed: July 10, 1975

[21] Appl. No.: 594,920

[52] U.S. Cl. ..... 175/384; 175/313; 299/81

[51] Int. Cl.[2] ..... E21B 9/22

[58] Field of Search ..... 175/384, 336, 202, 286, 175/266, 313, 382, 383, 342; 299/80, 81, 56

[56] References Cited

UNITED STATES PATENTS

| | | | |
|---|---|---|---|
| 786,952 | 4/1905 | Clark | 175/202 |
| 883,137 | 3/1908 | Karns | 299/80 |
| 1,858,926 | 5/1932 | Grau et al. | 175/286 |
| 2,389,920 | 11/1945 | Mavor | 299/80 |
| 2,879,049 | 3/1959 | Poundstone | 175/384 X |
| 2,998,964 | 9/1961 | Morlan | 175/266 |
| 3,232,670 | 2/1966 | Robbins et al. | 299/56 |
| 3,583,503 | 6/1971 | Coski | 175/336 |
| 3,722,957 | 3/1973 | Snyder et al. | 175/336 |

*Primary Examiner*—Ernest R. Purser
*Assistant Examiner*—Richard E. Favreau
*Attorney, Agent, or Firm*—Eddie E. Scott

[57] ABSTRACT

An adjustable gage cutter scraper system is provided to clear a path through fallen rock and muck in a tunnel invert. The scraper system protects the gage cutters from recutting or regrinding the rock and muck and thus prevents or retards excessive wear of the gage cutters. Scraper blades are positioned proximate the periphery of the rotary head immediately preceding the gage cutters. Retaining members on the rotary head restrain movement of the scraper blades in all directions other than radially from the central axis of the rotary head. Driver members on the rotary head are selectively used to move the scraper blades radially. The driver members adjust the position of the scraper blades relative to the tunnel wall, thereby compensating for blade wear and maintaining effective protection for the gage cutters.

5 Claims, 4 Drawing Figures

ADJUSTABLE GAGE CUTTER SCRAPER FOR TUNNELING MACHINES

BACKGROUND OF THE INVENTION

The present invention relates to the art of earth boring, and more particularly, to an earth boring machine that produces a tunnel through the earth wherein portions of the earth formations at the face of the tunnel are broken away, falling to the tunnel invert. This type of earth boring machine is generally characterized by a rotary head connected to the body of the machine. The rotary head includes cutters for contacting the face of the bore and loosening material at the face. The cutters positioned on the periphery of the rotary head are referred to as gage cutters because they perform the function of maintaining full gage size of the tunnel. The material loosened by the cutters falls to the invert of the tunnel where it accumulates and must be picked up for removal. The removal is generally performed by buckets attached to the rotary head.

Gage cutter scrapers may be positioned immediately ahead of the gage cutters. The gage cutter scrapers clear a path through the material accumulated in the tunnel invert to protect the gage cutter from recutting or regrinding this material. The gage cutters are thus prevented from unnecessary wear. Since the gage cutter scrapers are subjected to severe abrasive wear, they must frequently be adjusted to maintain the desired clearance between them and the tunnel wall. One approach has been to utilize gravity-actuated scrapers which utilize the force of gravity acting on the scraper blades. The scraper blades are free to move in and out relative to the wall of the tunnel. There is a tendency for the clearance spaces on the gravity-actuated scraper blades to become impacted with muck and thus prevented from moving freely. Another approach is self-adjusting scraper blade assemblies. The self-adjusting scraper blade assemblies have springs that force the scraper blades outward maintaining contact with the tunnel wall. This type of scraper blade system has a tendency toward excessive scraper blade wear and for impacted debris to render the springs ineffective. Another approach is a manually adjusted scraper blade system. The manually adjusted scraper blades have a tendency to be difficult to adjust. Since the adjustment locking mechanisms must be sufficient to resist the forces tending to drive the scraper blades away from the tunnel wall, the locking mechanisms produce problems when it becomes time to adjust position of the scraper blades. For example, flat plate-type scraper blades secured by friction-type bolting arrangements must be clamped with a force of sufficient magnitude to prevent the force acting to drive the scraper blades away from the tunnel wall from displacing the scraper blades. The direct-acting friction joint must be of such size and requires such a number of bolts that problems arise in subsequently adjusting the position of the blades. It will therefore be appreciated that a need clearly exists for a gage cutter scraper that may be easily and quickly adjusted.

DESCRIPTION OF PRIOR ART

In U.S. Pat. No. 1,371,224 to L. W. Campbell patented Mar. 15, 1921, a tunneling machine is shown. The tunneling machine comprises a cutterhead rotatable about a substantially horizontal axis for loosening material at the face of the cut, means for picking up the loosened material which falls to the bottom of the bore, means for causing said pick up member to travel in a definite path at the bottom of said bore, and means whereby the path of said pick up member at the bottom of said bore may be varied to enable it to be used with tunnels having bores of different dimensions. Plows may be attached to the buckets to guide the excavated material into the path of the buckets.

In U.S. Pat. No. 3,232,670 to R. J. Robins et al. patented Feb. 1, 1966, a tunnel boring rotary head with adjustably mounted gage cutters is shown. A large circular head is mounted at the front of the body of the machine for rotary motion about the longitudinal axis of the machine. The head is powered for rotary motion and for progressive axial motion in the intervals between the steps of travel. The head carries a plurality of outrigger bucket members which are or may be evenly spaced along the circumference of the head. Cutters are mounted on the front face plate and also on the outrigger bucket members. As the head rotates and at the same time advances, the bucket members follow a spiral path along the circumference of the end wall of the tunnel and act to scoop up rock and other debris cut by the cutters from such end wall. The buckets carry the debris to the top of the machine. There the contents of the buckets discharge by gravity onto an endless conveyor which carries the debris to the rear of the machine. The outrigger buckets are hinged and may be selectively swung inward for servicing.

SUMMARY OF THE INVENTION

The present invention is incorporated in a tunneling machine that includes a rotary head which rotates about a central axis and at least one gage cutter located proximate the periphery of the rotary head. During the boring of the tunnel portions of formations are broken away from the face of the tunnel and fall to the tunnel invert where they accumulate prior to their removal. A scraper blade is located proximate the periphery of the rotary head adjacent the gage cutter to plow a path through the accumulated debris ahead of the gage cutter. The scraper blade includes an adjustment surface and an axis of translation. Retaining means are located on the rotary head for restraining the scraper blade from movement in substantially all directions other than radially from the central axis along the scraper blade axis of translation. A locking and adjustment member is located on the rotary head. The locking and adjustment member includes an axis of translation and a surface in contact with the adjustment surface of the scraper blade. The plane of contact of said surface and said adjustment surface is at an angle to both said scraper blade axis for translation and said locking and adjustment member axis of translation. The above and other features and advantages of the present invention will become apparent from a consideration of the following detailed description of the invention when taken in conjunction with the accompanying drawings.

DETAILED DESCRIPTION OF THE INVENTION

Figure 1:
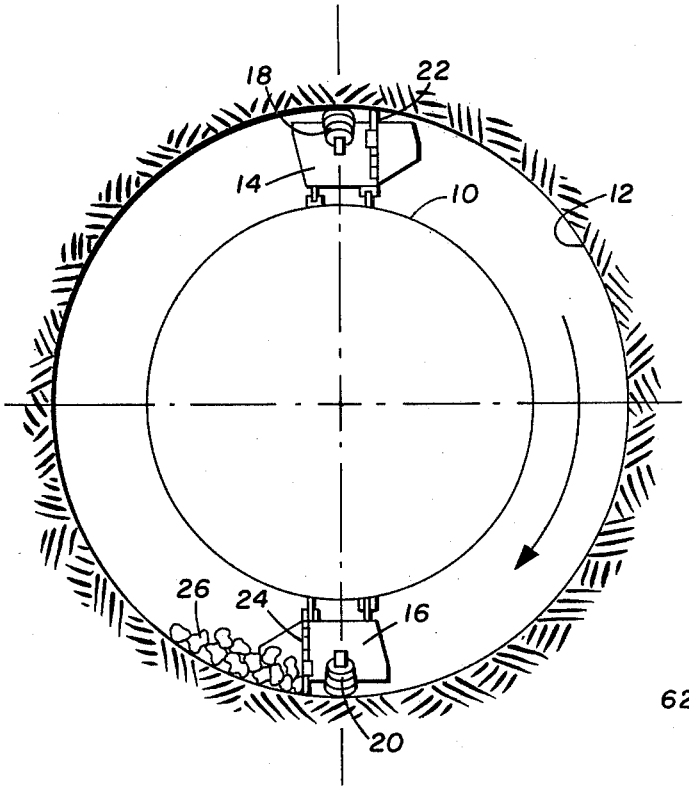
FIG. 1 is an illustration of a front view of a tunnel and a representation of the cutterhead of a tunneling machine.

Referring now to the drawings and in particular to FIG. 1, a tunneling machine 10 is illustrated as being positioned in a tunnel 12 and viewed from the face of the tunnel. The tunneling machine 10 generally comprises a rotary cutterhead and a main body. The cutterhead is rotated by a power unit in the main body. The cutterhead includes a multiplicity of rolling cutters that contact and disintegrate the formations at the face of the tunnel 12. Two such cutters 18 and 20 are illustrated in FIG. 1. The cutters 18 and 20 are referred to as gage cutters because they perform the function of maintaining full gage size of the tunnel 12. The cutters are forced against the tunnel face as the rotary cutterhead is rotated. Portions of the formations break away from the face and fall to the invert of the tunnel where they accumulate as illustrated at 26 and must be picked up for removal. A plurality of buckets mounted on the cutterhead assembly scoop up the drilling debris 26 from the invert and carry it to the top of the tunnel where it is emptied into a chute and falls onto an endless belt conveyer. Buckets 14 and 16 are illustrated in FIG. 1.

The accumulation of the drilling debris 26 in the invert of the tunnel tends to cause excessive wear and premature failure of gage cutters such as gage cutters 18 and 20. As the gage cutters move through the invert of the tunnel, they would normally be required to recut and regrind the drilling debris 26 accumulated in the invert. In order to prevent this excessive wear and premature failure of the gage cutters, gage cutter scrapers are positioned immediately ahead of the gage cutters. Gage cutter scrapers 22 and 24 are illustrated in FIG. 1. As the cutterhead rotates, the gage cutter scrapes plow a path through the drilling debris 26 for the trailing gage cutter. This prevents the gage cutters from recutting or regrinding the accumulated drilling debris 26. The gage cutter scrapers must frequently be readjusted to maintain the desired clearance between them and the tunnel wall in order to provide effective protection for the trailing gage cutters.

Figure 2:
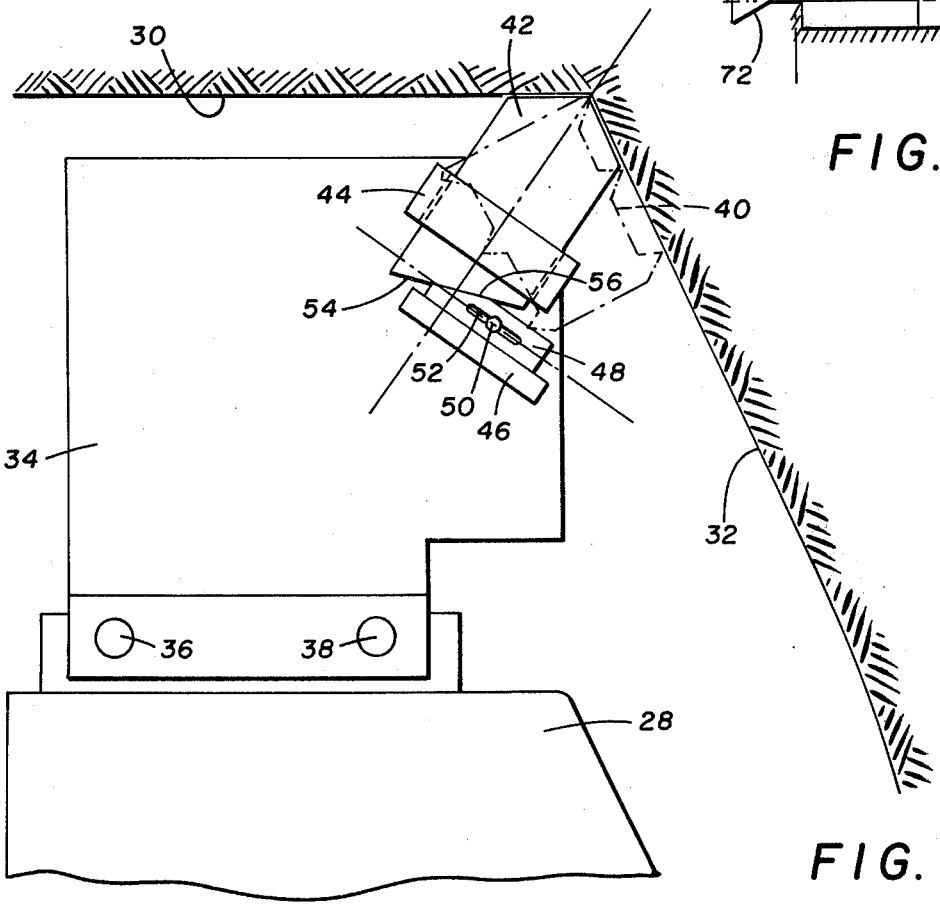
FIG. 2 is an illustration of a side view of a portion of a tunnel showing the upper portion of a cutterhead.

Referring now to FIG. 2, a side view of a tunnel 30 is illustrated. The upper portion of a tunneling machine rotary cutterhead 28 is shown positioned in the tunnel 30. A bucket 34 forms part of the cutterhead 28. The bucket 34 is connected to the body of the cutterhead 28 by bolts 36 and 38. A triple disc gage cutter 40 is shown in phantom mounted on the bucket 34. The triple disc cutter 40 contacts the face 32 of the tunnel at the gage of the tunnel. A scraper blade 42 is positioned ahead of the gage cutter 40. The scraper blade 42 is positioned in a retaining member 44. The scraper blade 42 may move radially along the axis of translation but is prevented from moving in any other direction. A fixed support member 46 is positioned below the scraper blade retaining member 44. A locking and adjustment member 48 is positioned on the fixed support member 44 and adapted to move on the fixed support member along the axis of translation of the locking and adjustment member 48. A bolt 50 positioned within a slot 52 in the locking and adjustment member 48 allows the locking and adjustment member 48 to be selectively secured to the cutterhead 28 or moved along its axis of translation. A lower surface 54 on the scraper blade 42 mates with a surface 56 on the locking and adjustment member 48. The plane of contact of the surfaces 54 and 56 is at an angle to both the axis of translation of the locking and adjustment member 48 and the axis of translation of the scraper blade 42. It will be appreciated that the present invention provides a positive non-slip clearance limiting means between the scraper blade and the tunnel wall while allowing quick, easy adjustment of the scraper blade relative to the tunnel wall. The use of the principle of an inclined plane to gain mechanical advantage is utilized.

The structural details of an adjustable gage cutter scraper for a tunneling machine constructed in accordance with the present invention having been described, the operation of boring a tunnel with the adjustable gage cutter scraper of the present invention will now be considered. The main body of the earth boring machine is locked to the tunnel by retractable grippers or other conventional means (not shown). Simultaneously, the cutterhead is rotated, whereupon the cutters contact and disintegrate the formations causing drilling debris to fall to the invert of the tunnel. The accumulation of this drilling debris is the invert of the tunnel would cause excessive wear and premature failure of the gage cutters if the gage cutters were allowed to recut and regrind this material. The scraper blade 42 shown in FIG. 2 plows through the accumulated drilling debris ahead of the gage cutter 40, thereby plowing a path through the drilling debris and protecting the gage cutter 40. The position of the scraper blade 42 relative to the wall of the tunnel may be adjusted by movement of the locking and adjustment member 48. The bolt 50 is loosened, and the locking and adjustment member 48 is moved along its axis of translation. The angled surfaces 54 and 56 cause the scraper blade 42 to move along its axis of translation to the desired position. A hammer blow on the locking and adjustment member 48, tending to force it toward the scraper blade 42 along its axis of translation, will force the scraper blade 42 closer to the tunnel wall with a force of greater magnitude than the original hammer blow due to the inclined plane effect. It is clear that infinite adjustment, within the physical limits of the mechanism, can be made. The bolt 50 is again tightened and the system is ready for operation. In a preferred form of the invention, the angle between the mating surfaces 54 and 56 and the surface of the fixed support member 46 is such that the friction between the fixed support member 46 and the locking and adjustment member 48 is sufficient to resist the resultant force from the force induced into the scraper blade 42 along the axis of translation, tending to push the locking and adjustment member 48 away from the scraper blade. No load is taken by the bolt 50, which is simply used as a retainer to prevent vibration loosening of the locking and adjustment member 48.

Figure 3:
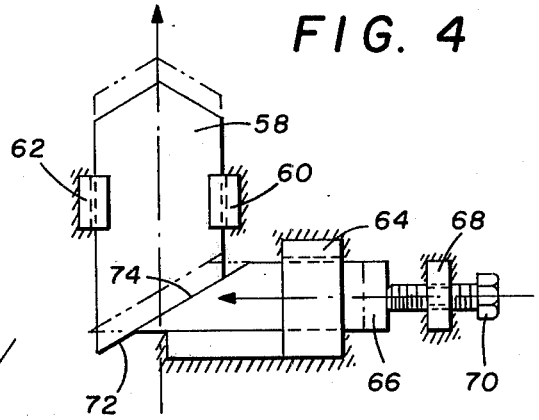
FIG. 3 is an illustration of a second embodiment of a scraper blade of the present invention.

Referring now to FIG. 3, a second embodiment of an adjustable gage cutter scraper is illustrated. A scraper blade 58 is positioned in a cooperating pair of retaining members 60 and 62. The scraper blade 58 may move radially along its axis of translation but is prevented from moving in any other direction. A fixed support member 64 is positioned proximate the scraper blade 58. A locking and adjustment member 66 is positioned to slide in the fixed support member 64. The locking and adjustment member 66 is adapted to move through the fixed support member 64 along an axis of translation. A screw 70 is positioned in a threaded fixed support member 68. The screw 70 may be rotated to move the locking and adjustment member 66 along the axis of translation. A lower surface 72 on the scraper blade 58 mates with a surface 74 on the locking and adjustment member 66. The plane of contact of the surfaces 72 and 74 is at an angle to both the axis of translation of the locking and adjustment member 66 and the axis of translation of the scraper blade 58.

During a tunneling operation the scraper blade 58 shown in FIG. 3 plows through the accumulated drilling debris ahead of the trailing gage cutter (not shown), thereby plowing a path through the drilling debris and protecting the gate cutter. The position of the scraper blade 58 relative to the wall of the tunnel may be adjusted by movement of the locking and adjustment member 66. The screw 70 is rotated, and the locking and adjustment member 66 is moved along its axis of translation. The angled surfaces 72 and 74 cause the scraper blade 58 to move along its axis of translation to the desired position and the system is ready for operation.

Figure 4:
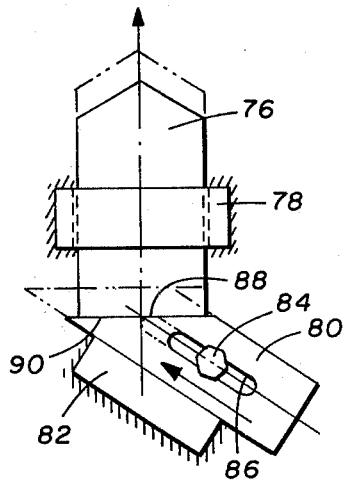
FIG. 4 is an illustration of another embodiment of a scraper blade of the present invention.

Referring now to FIG. 4, another embodiment of an adjustable gage cutter scraper is illustrated. A scraper blade 76 is positioned in a retaining member 78. The scraper blade 76 may move radially along its axis of translation but is prevented from moving in any other direction. A fixed support member 82 is positioned below the scraper blade 76 at an angle to the axis of translation of the scraper blade 76. A locking and adjustment member 80 is positioned to slide upon the fixed support member 82 along an axis of translation. A bolt 84 positioned within a slot 86 in the locking and adjustment member 80 allows the locking and adjustment member 80 to be selectively secured to the cutterhead or moved along its axis of translation. A lower surface 90 on the scraper blade 76 mates with a surface 88 on the locking and adjustment member 80. The plane of contact of the surfaces 88 and 90 is at an angle to both the axis of translation of the locking and adjustment member 80 and the axis of translation of the scraper blade 76. It will be appreciated that the mating surfaces of the scraper blade and the locking and adjustment member need not be plane surfaces but could have various shapes. For example, the surfaces 54, 72 and 90 in FIGS. 2, 3 and 4 respectively could be curved surfaces. It will also be appreciated that the present invention provides a positive non-slip clearance limiting means between the scraper blade and the tunnel wall while allowing quick, easy adjustment of the scraper blade relative to the tunnel wall. The use of the principle of an inclined plane to gain mechanical advantage is utilized.

The embodiments of the invention in which an exclusive property or privilege is claimed are defined as follows:

1. In an earth boring machine for producing a bore in earth formations wherein portions of the formations are broken away causing the portions of the formations of fall to the bottom of the bore, said machine including a body portion and a rotary head that rotates about a central axis of rotation, the improvement comprising:

a gage cutter, said gage cutter including a rolling body portion rotatably mounted on said rotary head;

a scraper blade located on said rotary head that rotates with said rotary head and precedes said gage cutter;

holder means on said rotary head for restraining said scraper blade from movement in substantially all directions other than a radial direction from said central axis of rotation; and driver means on said rotary head for forcing said scraper blade to move radially within said holder means.

2. In an earth boring machine for producing a bore in earth formations wherein portions of the formations are broken away causing the portions of the formations to fall to the bottom of the bore, said machine including a body portion and a rotary head that rotates about a central axis of rotation, the improvement comprising:

a gage cutter, said gage cutter including a rolling body portion rotatably mounted on said rotary head;

a scraper blade located on said rotary head that rotates with said rotary head and precedes said gage cutter, said scraper blade having a scraper blade adjustment surface;

holder means on said rotary head for restraining said scraper blade from movement in substantially all directions other than a radial direction from said central axis of rotation; and a driver means on said rotary head for forcing said scraper blade to move radially within said holder means, said driver means having an inclined adjustment surface that mates with said scraper blade adjustment surface.

3. In an earth boring machine for producing a bore in earth formation wherein portions of the formations are broken away causing the portions of the formations to fall to the bottom of the bore, said machine including a body portion and a rotary head that rotates about a central axis of rotation, the improvement comprising:

a gage cutter, said gage cutter including a rolling body portion rotatably mounted on said rotary head;

a scraper blade located on said rotary head that rotates with said rotary head and precedes said gage cutter, said scraper blade having a scraper blade adjustment surface;

holder means on said rotary head for restraining said scraper blade from movement in substantially all directions other than a radial direction from said central axis of rotation;

a drive member on said rotary head for forcing said scraper blade to move radially within said holder means, said drive member having an inclined drive member adjustment surface that mates with said scraper blade adjustment surface; and means contacting said drive member for allowing said drive member to be moved.

4. In an earth boring machine for producing a hole in the earth wherein portions of the formations fall to the invert of the tunnel, said machine including a body portion and a rotary head that rotates about a central axis, the improvement comprising:

at least one gage cutter member located proximate the periphery of said rotary head, said gage cutter member including a rolling body portion rotatably mounted on said rotary head;

a scraper blade located proximate the periphery of said rotary head adjacent said at least one gage cutter member, said scraper blade having an adjustment surface and an axis of translation;

retaining means on said rotary head for restraining said scraper blade from movement in substantially all directions other than radially from said central axis along said scraper blade axis of translation; and a locking and adjustment member on said rotary head, said locking and adjustment member having an axis of translation and a surface in contact with said adjustment surface of said scraper blade wherein the plane of contact of said surface and said adjustment surface is at an angle to both said scraper blade axis of translation and said locking and adjustment member axis of translation.

5. In an earth boring machine for producing a tunnel in the earth wherein portions of the formations fall to the invert of the tunnel, said machine including a body portion, a cutterhead that rotates about a central axis, and at least one gage cutter member located proximate the periphery of said cutterhead, the improvement comprising:

a scraper blade located proximate the periphery of said cutterhead adjacent said at least one gage cutter member, said scraper blade having an adjustment surface and an axis of translation;

retaining means on said cutterhead for restraining said scraper blade from movement in substantially all directions other than radially from said central axis along said scraper blade axis of translation;

a fixed support member on said cutterhead;

a locking and adjustment member positioned to move along said fixed support member, said locking and adjustment member having an axis of translation and a wedge surface in contact with said adjustment surface of said scraper blade wherein the plane of contact of said wedge surface and said adjustment surface is at an angle to both said scraper blade axis of translation and said locking and adjustment member axis of translation; and means in contact with said locking and adjustment member for allowing said locking and adjustment member to be moved.

* * * * *

UNITED STATES PATENT OFFICE

CERTIFICATE OF CORRECTION

Patent No. 3,989,115 Dated November 2, 1976

Inventor(s) Albert Robin Ambrose

It is certified that error appears in the above-identified patent and that said Letters Patent are hereby corrected as shown below:

Column 5, line 60, "of", first occurrence, should read -- to --.

Column 6, line 31, "formation", first occurrence, should read -- formations --.

Signed and Sealed this

Eleventh Day of January 1977

[SEAL]

*Attest:*

RUTH C. MASON
*Attesting Officer*

C. MARSHALL DANN
*Commissioner of Patents and Trademarks*